US005813550A

United States Patent [19]

Sheehan et al.

[11] Patent Number: 5,813,550

[45] Date of Patent: Sep. 29, 1998

[54] STORAGE RACK WITH THREADED PEGS

[76] Inventors: Michael P. Sheehan, 2675 S. Columbine St., Denver, Colo. 80210; Martin D. Gaeth, 8301 E. Lehigh Dr., Denver, Colo. 80237

[21] Appl. No.: 788,676

[22] Filed: Jan. 24, 1997

Related U.S. Application Data

[63] Continuation-in-part of Ser. No. 746,079, Nov. 6, 1996.

[51] Int. Cl.[6] ..... A47F 5/08

[52] U.S. Cl. ..... 211/87.01; 248/220.31

[58] Field of Search ..... 211/32, 34, 35, 211/87.01, 59.1, 70.5, 70.6; D6/569, 570, 552; 248/558, 220.31

[56] References Cited

U.S. PATENT DOCUMENTS

| | | | |
|---|---|---|---|
| D. 96,363 | 7/1935 | Arnold | 211/59.1 X |
| D. 191,709 | 11/1961 | Shock | D6/552 |
| D. 211,635 | 7/1968 | Holm | D6/552 |
| D. 291,031 | 7/1987 | Luongo | D6/569 X |
| D. 304,793 | 11/1989 | Burke | D6/569 |
| D. 306,385 | 3/1990 | Alexander et al. | D6/552 |
| D. 320,325 | 10/1991 | Barfield | D6/552 |
| 410,175 | 9/1889 | McAlister | 211/59.1 X |
| 444,328 | 1/1891 | Boss | 211/59.1 |
| 1,561,201 | 11/1925 | Wocel et al. | 211/59.1 |
| 3,941,343 | 3/1976 | Kennedy | 248/223 |
| 4,485,929 | 12/1984 | Betts, Sr. | 211/59.1 X |
| 4,606,466 | 8/1986 | Frederickson | 211/59.1 |
| 5,083,668 | 1/1992 | Bushey | 248/220.31 |
| 5,097,966 | 3/1992 | Miller | 211/87 |
| 5,499,724 | 3/1996 | Hickman | 211/70.6 |

FOREIGN PATENT DOCUMENTS 2224885 11/1973 Germany .

OTHER PUBLICATIONS

Popular Mechanics, article, item 2, published Feb. 1978.

*Primary Examiner*—Blair Johnson
*Attorney, Agent, or Firm*—John E. Reilly

[57] ABSTRACT

A storage rack which may be attached to a support surface, such as a wall, so that one or more objects may be placed upon the rack to be stored upon the wall. The storage rack has a compact base with two or more pairs of peg holes, and two or more pegs that may be inserted into any selected pair of the holes. Objects to be stored are placed on and between the inserted pegs. The holes and pegs are threaded so that the pegs can be securely screwed into the holes. The peg holes may be at an upward angle in the base, and the pegs may be provided with irregular or scalloped surfaces better to hang items securely thereon, or with hooks or eyelets to improve their reliability and versatility. Peg segments may be connected in series to adjust the functional length of a particular peg.

20 Claims, 5 Drawing Sheets

STORAGE RACK WITH THREADED PEGS

CROSS-REFERENCE TO RELATED APPLICATIONS

This application is a continuation-in-part of application Ser. No. 08/746,079 to Michael P. Sheehan and Martin D. Gaeth, filed Nov. 6, 1996, and entitled STORAGE RACK, the particulars of which are incorporated herein by reference.

BACKGROUND AND FIELD OF INVENTION

The invention relates to storage racks, and more particularly relates to a storage rack which may be mounted in different orientations in order to store or hang objects of differing sizes or configurations therefrom.

A variety of storage rack devices are known in the art for providing some flexibility in storing objects upon a supporting surface. U.S. Pat. No. 3,941,343 to Kennedy for example, discloses a bracket support assembly having a semi-flexible web portion to be mounted parallel to the support surface and having holes therein and a holding member thereon. Kennedy's bracket assembly uses only one hook bracket member, thus limiting the variety of sizes and types of objects it can store.

U.S. Pat. No. 5,097,966 to Miller discloses a storage rack having a very elongated base with a row of aligned equidistantly spaced holes for receiving support rods. The device permits some storage flexibility by fixing the elongated base in a horizontal position and inserting the support rods in various equidistantly horizontally spaced holes.

Other U.S. Patents of interest in the field include U.S. Pat. No. 4,606,466 to Fredrickson and U.S. Pat. No. 5,499,724 to Hickman.

Thus, a need remains for a storage rack device which is simple and very compact, but which is versatile to permit the storage thereon of objects of differing size or shape. Against the foregoing background, the present invention was developed.

SUMMARY OF THE INVENTION

An object of the invention is to provide a storage rack that is simple to make and use, but which may be manipulated to permit storage or suspension of objects of different sizes or shapes.

Another object of the invention is to provide a storage rack which is compact in size, may be used upon a narrow or small support surface, and, it is easy to reconfigure, transport, store, and install.

Another object of the invention is to provide a storage rack with specially shaped pegs which improve the reliability and versatility of the storage rack.

In accordance with the present invention, there is provided a storage rack apparatus comprising a base member attachable to an support surface and having a front surface and a back surface, a first pair of peg bores at least partially penetrating the base member and separated by a first distance, a second pair of peg bores at least partially penetrating the base member, and separated by a second distance, at least one of the peg bores having a threaded portion, and two elongate pegs, each insertable into the peg bores and at least one of the pegs having a threaded portion for screwed engagement with the threaded portion of at least one of the peg bores, wherein the first distance is substantially greater than the second distance, and wherein an imaginary line connecting said first pair of bores defines an angle with respect to an imaginary line connecting said second pair of bores. The invention includes specially shaped pegs for use with the base member, whereby at least one of the pegs includes an irregular surface, for example a series of circumferential concave depressions defining annular ridges, or alternatively a series of circumferential convex bumps. At least one of said pegs may include an eyelet aperture therethrough, or a hooked portion. Threaded pegs may also be connected in series.

In further accordance with the present invention, there is provided a storage rack apparatus for storing objects of disparate sizes upon an upright support surface, the apparatus comprising a base member attachable upon the support surface, the base member comprising a front surface and a back surface, a first pair of peg apertures in the front surface and separated by a first distance, a first pair of peg bores, each peg bore at least partially penetrating the base member from a corresponding one of the first pair of peg apertures, each bore comprising an axis and a threaded portion, the base member further comprising a second pair of peg apertures in the front surface and separated by a second distance substantially shorter than the first distance, and a second pair of peg bores, each peg bore at least partially penetrating the base member from a corresponding one of the second pair of peg apertures, and each bore comprising an axis and a threaded portion, the apparatus also including means for attaching the base member to the support surface, and at least two elongate threaded pegs for threaded engagement into a selected pair of the pairs of peg bores, wherein when the base member is attached upon the upright support surface, the apertures corresponding to the selected pair of peg bores define a substantially horizontal imaginary line, and the apertures corresponding to the other pair of said pairs of peg bores define a second imaginary line intersecting the horizontal imaginary line.

Also in accordance with the present invention, there is provided a storage rack apparatus comprising a base member attachable to an support surface, the base member having a front surface and a back surface, a first pair of peg bores at least partially penetrating the base member, and separated by a first distance, a second pair of peg bores at least partially penetrating the base member, and separated by a second distance, and the apparatus also comprising two elongate pegs, each of the pegs insertable into the peg bores and at least one of the pegs includes an irregular surface, wherein an imaginary line connecting the first pair of bores defines an angle with respect to an imaginary line connecting the second pair of bores.

The above and other objects, advantages and features of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
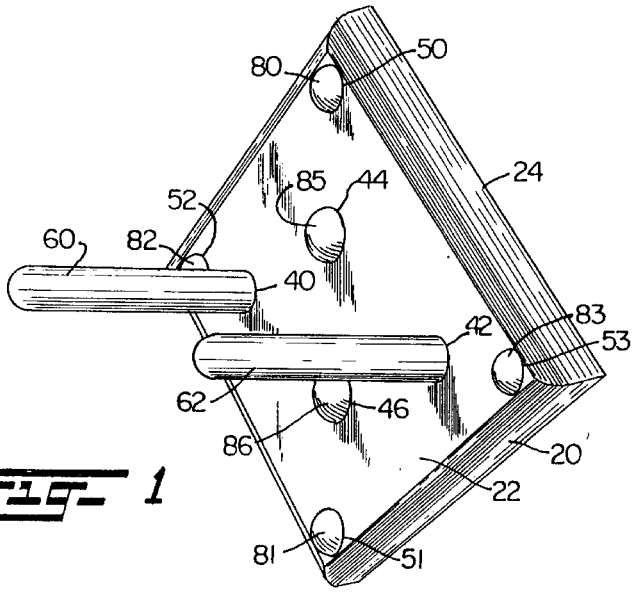
FIG. 1 is a perspective view of a preferred embodiment of the invention, showing a pair of pegs in one pair of bores in a base member and additional pairs of pegs.

The preferred embodiment of the apparatus of the invention comprises a storage rack for use upon an upright support surface such as a wall, pillar, or wide post, door or the like. It is contemplated that the support surface be substantially vertical from the floor or ground, but this is not absolutely necessary to the practice of the invention. The apparatus of the invention may be used singly or in groups, and if used in groups may be positioned in vertical or horizontal rows, or in abstract or geometric arrays, upon the support surface. Accordingly, a plurality of the racks of this invention may be used to store separate objects at various heights above the floor, on either side of a window or the like, and otherwise may take into account the particular configuration or condition of the support surface.

The invention finds utility for the storage of a variety of objects, such as common household items, yard and garden tools, sporting goods, and equestrian tack. Typical examples of items storable by hanging on the apparatus include brooms, mops, rakes, hoes, shovels, ski poles, back packs, lacrosse sticks, and the like. The apparatus may also be used to store items of clothing such as coats, ties, belts, bathroom towels and robes, and the like.

Notably, the apparatus of the invention is compact, and may be attached to a small support surface, such as, upon a narrow wall space confined between the corner of a room and a nearby door frame, or upon a post, or upon either side of a narrow door. Despite this compactness, the invention is versatile to permit a single apparatus to be used to store objects of different sizes. By merely adjusting the position of the apparatus with respect to the support surface, the user can adapt the apparatus to store items of disparate sizes. Furthermore, a single rack may be utilized to store simultaneously a plurality of items.

It will be apparent to one skilled in the art that the apparatus of the invention may also be usefully employed in pairs or in an array upon a support surface. For example, a pair of storage racks may be utilized side-by-side to store a long item horizontally. Other uses will be evident and within the scope of the appended claims.

Referring generally to the drawings, wherein like reference numerals and symbols designate the same elements, there is seen in FIGS. 1–5 a preferred embodiment of the apparatus of the invention, and in FIGS. 6–12 an alternative embodiment. A single exemplar of the apparatus may be used to store items (not shown) of different sizes by merely modifying the position of the apparatus with respect to the support surface 28 upon which it is mounted. The apparatus includes a base 20 (FIGS. 1–5) or 20' (FIGS. 6–18) attachable to the support surface 28 in at least two different positions (for example, comparing FIG. 2 with FIG. 3, and FIG. 8 with FIG. 9, respectively). There are at least two pairs of peg apertures (designated by 40, 42 and 44, 46 in FIGS. 1–5, and by 40', 42' and 44' and 46' in FIGS. 8–13) in the base 20 or 20', with the distance between the apertures of one pair being greater than the distance between apertures of the other pair. Each of the apertures represents the opening on surface 22 of a respective one of at least four peg bores 30, 32, 34, 36 or 30', 32', 34', 36'.

As shall be more fully described herein, the particular base 20 or 20' used, and the orientation of the base upon the support surface 28 are selected in consideration of, among other factors, the amount of available space upon the supporting surface. One pair of apertures is selected whose separation distance more closely corresponds to a dimension of the object or objects to be stored. The base 20, or 20' is attached to the support surface 28 with the selected apertures defining a generally horizontal line. Pegs 60 and 62, or 60' and 62', are inserted into each of the selected pair of apertures, and held therein preferably by friction, or by glue, or other suitable means, including screwed insertion as described herein. The one or more objects to be stored is then hung on, over, and/or between the pegs 60, 62 or 60, 62'.

Figure 2:
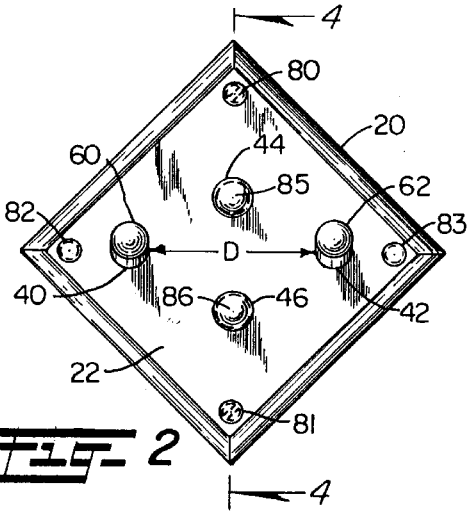
FIG. 2 is a front view of the preferred embodiment.
Figure 3:
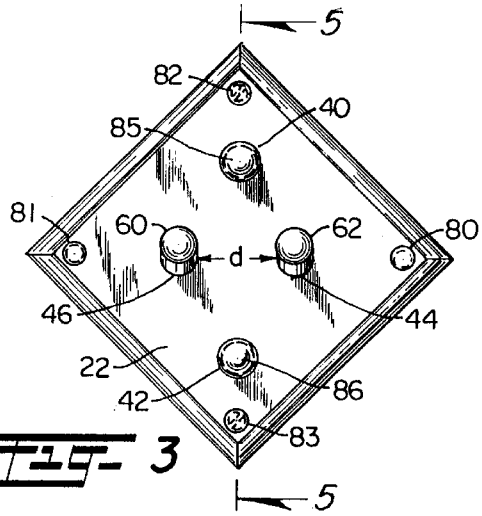
FIG. 3 is another front view of the preferred embodiment, showing the invention rotated approximately ninety degrees from the view in FIG. 2, also showing the pegs in another pair of peg bores.
Figure 4:
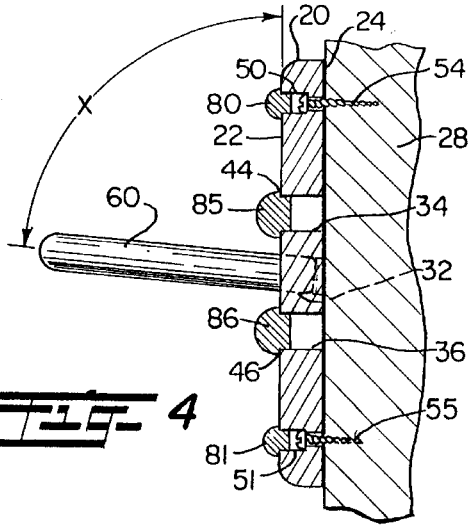
FIG. 4 is a side sectional view of the preferred embodiment, taken substantially along line 4—4 in FIG. 2 and attached to a support surface.
Figure 5:
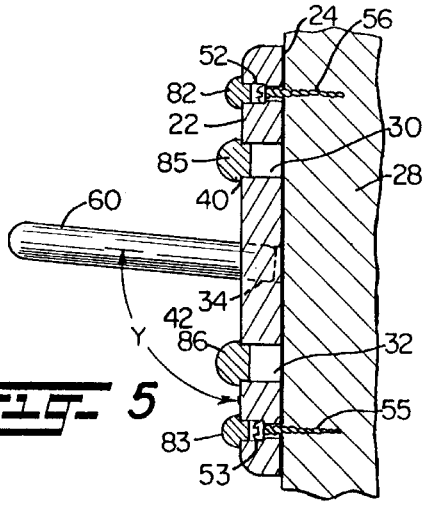
FIG. 5 is another side sectional view of the preferred embodiment, taken substantially along line 5—5 in FIG. 3 and attached to a support surface.

Particular reference is made to FIGS. 1–5. The base member 20 may be of nearly any practicable shape suggested by design, but preferably has a substantially flat front surface 22 and a substantially flat back surface 24. The base member 20 is attachable to the support surface 28 with the back surface 24 placed in parallel contact with the support surface 28. The base member 20 preferably is bilaterally symmetrical about two axes, there being shown by way of example a square base member 20 in FIGS. 1–3 and an elliptical base member 20' in FIGS. 6–9. The base member 20 is substantially solid and preferably is composed of wood. The thickness of the base member, that is the dimension separating the front surface 22 from the back surface 24, is comparatively modest relative to the other dimensions of the base member 20, but yet is adequate to define a plurality of peg bores 30, 32, 34, 36 therein, as shown in FIGS. 4 and 5.

FIGS. 1–5 illustrate that in one preferred embodiment, the base member 20 has at least four peg bores 30, 32, 34, 36 therein. The peg bores are provided in corresponding pairs, a first pair 30, 32 and a second pair 34, 36. As best shown by FIGS. 4 and 5, in this embodiment all the peg bores 30, 32, 34, 36 preferably completely penetrate the base member 20. Each pair of peg bores 30, 32 and 34, 36 define in the front surface 22 the corresponding pairs of apertures 40, 42 and 44, 46, respectively, where the peg bores 30, 32, 34, 36 open at the front surface 22. Each of the peg bores 30, 32, 34, 36 has a longitudinal axis, and preferably is axially symmetrical. The axes of associated pairs of peg bores 30 and 32 or 34 and 36 very preferably are parallel.

In the preferred embodiment, the peg bores 30, 32, 34, 36, completely penetrate the base member 20. With peg bores completely piercing the base member 20 from front surface 22 to back surface 24, it is desirably possible to adjust the position of a peg 60 or 62 disposed in a particular peg bore by tapping on that peg from the direction of the back surface 24. Alternative embodiments may include peg bores which only partially penetrate the base member 20, so that an interior portion of the base member 20 separates each peg bore 30, 32, 34, 36 from the back surface 24.

Peg bores 30, 32, 34, 36 are cylindrical to correspond to at least two cylindrical pegs 60, 62. Pegs 60, 62 are elongated dowels, preferably fashioned from solid wood, and are insertable axially into the peg bores 30, 32, 34, 36. In alternative embodiments, including a desirable alternative described herein, peg bores 30, 32, 34, 36 and pegs 60, 62 may have other cross-sectional shapes.

Any mutually associated pair of pegs 60, 62 are substantially equal in length. As shown in FIGS. 1, 4, and 5, the pegs 60, 62 have sufficient length so that when they are in mated engagement with peg bores 30, 32, or 34, 36, each peg 60, 62 extends forwardly, that is, away from the front surface 22, out from the base member 20 to feature a free end projecting into space. In the preferred embodiment, both ends of each of the pegs 60, 62 are rounded to foster a smooth, nearly effortless insertion of either end of the pegs 60, 62 into the peg bores 30, 32, 34, 36.

Preferably, the pairs of peg bores 30, 32 and 34, 36 are disposed in the base member 20 so that the corresponding pairs of apertures 40, 42 and 44, 46, respectively, are arranged at substantially right angles to one another. FIGS. 2 and 3 illustrate that an imaginary line connecting the first pair of apertures 40 and 42 (specifically, connecting the centers of the apertures) is substantially perpendicular to an imaginary line connecting the second pair of apertures 44 and 46.

Particular reference is made to FIGS. 2 and 3. The first pair of apertures 40 and 42 are separated by a distance D. The second pair of apertures 44 and 46 are separated by a second distance d. The distance D is substantially greater than the distance d. The difference between the distances D and d is predetermined, and may vary between exemplar of the apparatus to provide a variety of storage capabilities among an assortment of racks.

Accordingly, the distance between inserted pegs 60, 62 depends upon whether the pegs 60, 62 are in the first pair of peg bores 30, 32, or the second pair of peg bores 34, 36. For example, as seen in FIGS. 1 and 2, the base member 20 may be attached to the support surface 28 in a position whereby the first pair of apertures 40 and 42, define a substantially horizontal line. When the pegs 60, 62 are inserted into the corresponding first pair of apertures 40, 42 as shown in FIG. 2, the pegs 60, 62 are separated by a distance approximately equalling D. In this configuration, the apparatus is positioned to store a larger item by hanging the item on, over, and/or between the spaced-apart pegs 60 and 62.

Notably, the same apparatus may be adapted for storing a smaller item thereon merely by rotating the base member 20 approximately ninety degrees to the position shown in FIG. 3 and attaching it to the support surface 28. In the position of FIG. 3, the second pair of apertures 44 and 46 define a substantially horizontal line. When the two pegs 60, 62 are inserted into the associated second pair of peg bores 34 and 36, the pegs 60, 62 are separated by a distance approximately equalling d. In this configuration, the apparatus is positioned to store a comparatively smaller item by hanging the item on and between the more closely spaced pegs 60 and 62. A person of ordinary skill in the art will readily appreciate that by providing a plurality of racks manifesting various permutations of different distances d and D between pairs of peg bores, a plurality of these inventive racks can satisfy a multitude of different storage demands.

When the pegs 60, 62 have been inserted into a selected pair of peg bores 30, 32 or 34, 36, the unused other pair of peg bores may be cosmetically covered by inserting dowel buttons 85, 86 therein as shown in FIGS. 1–5. Thus versatility is provided without seriously impacting the appearance of the apparatus.

In the illustrated embodiment, the base member 20 also has a plurality of countersunk mounting holes 50, 51, 52, 53 therethrough, through which connectors 54, 55, 56, 57 such as screws, brads, or the like may be passed to attach the base member to the support surface 28. Once the base member 20 is attached to the support surface 28, the mounting holes 50, 51, 52, 53 and the connectors 54, 55, 56, 57 may be aesthetically masked by inserting dowel buttons 80, 81, 82, 83 into the countersunk mounting holes as shown in FIGS. 1–5.

Continued reference is made to FIGS. 1–5. To improve the security with which stored items are hung upon the pegs 60, 62, each pair of peg bores 30, 32 and 34, 36, preferably penetrates the base member 20 at an angle such that when the inserted pegs 60 62 are inclined upwardly and forwardly from the base member 20. Thus, as seen in FIG. 4, the axes of the first pair of peg bores 30, 32 define an angle X with respect to the front surface 22. Similarly and as shown in FIG. 5, the axes of the second pair of peg bores 34, 36 define an angle Y with respect to the front surface 22. Whenever pegs 60 and 62 are inserted into either pair of peg bores 30, 32 or 34, 36, the pegs 60, 62 thereby define an acute angle with the base member 20, and extend upwardly from the supporting surface so that items disposed thereon will tend by gravity to remain in place.

Angle X may, but does not necessarily, substantially equal angle Y. It may be desirable to make angles X and Y unequal, which inequality may expand the versatility of the invention in some applications. However, the respective pairs of peg bores 30, 32 and 34, 36 are slanted into the base member 20 such that when a given pair (for example 40, 42) of either of the corresponding pairs of apertures are positioned substantially horizontally (for further example as depicted in FIG. 2), the angle defined between the axis of each of the corresponding peg bores (30, 32) and the front surface 22 is contained substantially within an imaginary vertical plane. By this configuration, the base member 20 is consistently attachable to the support surface 28 in a position where one of either pairs of apertures 40, 42 or 44, 46 defines an imaginary horizontal line, and where the axes of the corresponding pair of peg bores (30, 32 or 34, 36, respectively) are angled upwardly and outwardly from the support surface 28 as shown in FIGS. 4 and 5.

Consequently and notably, in the preferred embodiment and as best shown by combined reference to FIGS. 2–5, the axes of the first pair of peg bores 30, 32 are skewed with respect to the axes of the second pair of peg bores 34, 36. Skewed in this sense means neither parallel nor intersecting, regarding infinite lines. This skewed positional relationship of the respective pairs of peg bores 30, 32 and 34, 36, permits the base member 20 to be rotated upon the support surface 28, prior to being attached thereto, to properly position either pair of peg bores to receive the pegs 60, 62 in an upward angled disposition.

Figure 6:
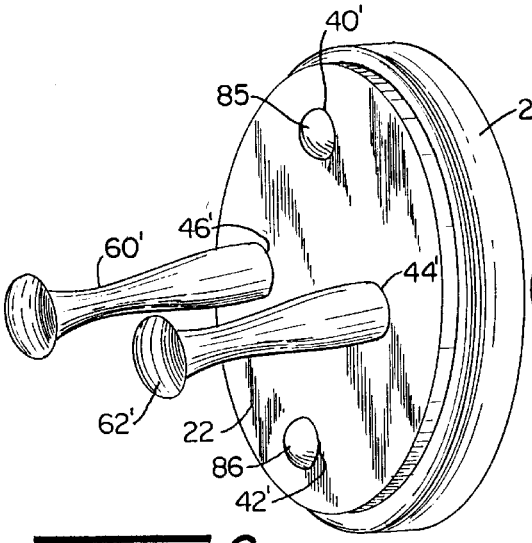
FIG. 6 is a perspective view of an alternative embodiment of the invention.
Figure 7:
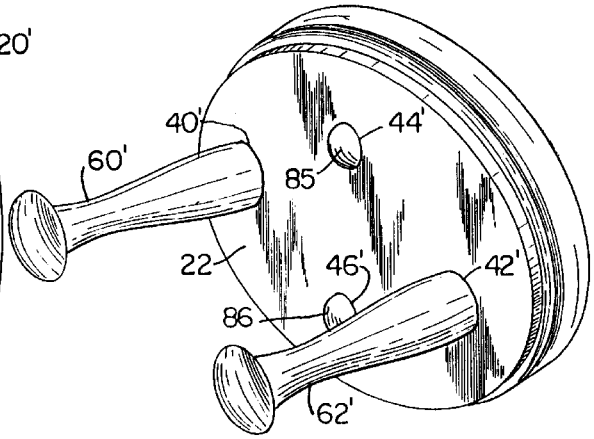
FIG. 7 is another perspective view of the alternative embodiment, showing the invention rotated approximately ninety degrees from the view in FIG. 6.
Figure 8:
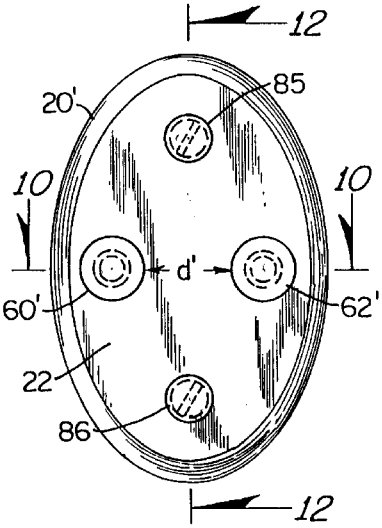
FIG. 8 is a front view of the alternative embodiment.
Figure 9:
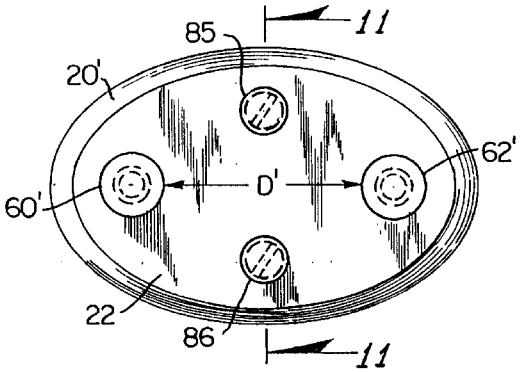
FIG. 9 is another front view of the alternative embodiment, showing the invention rotated about ninety degrees from the view in FIG. 8.

FIGS. 6–12 show an alternative embodiment of the invention. The alternative embodiment is substantially similar in most respects to the preferred embodiment, and like reference numerals and symbols designate elements of substantially similar form and function. In the alternative embodiment, the base member 20' may be oval or ellipsoid in outline. As with the preferred embodiment, the alternative embodiment may be attached to the support surface 28 in two functional positions, shown in FIGS. 6 and 7. In FIGS. 6 and 8, the base member 20' is positioned to place the second pair of peg apertures 44', 46' substantially horizontal to receive the pegs 60', 62' therein. The second pair of apertures 44', 46' are separated by a distance d' (not necessarily equal to d in the preferred embodiment). The first pair of apertures 40', 42', in this instance not used to frictionally receive pegs 60', and 62', are cosmetically covered using dowel buttons 85, 86 inserted therein. FIGS. 7 and 9, in contrast, show the base member 20' in a position rotated ninety degrees from the position of FIG. 6, so that the first pair of apertures 40', 42' are in a horizontal position separated by a distance D' and frictionally receive the pegs 60' 62' therein. In this alternative embodiment, the peg bores 30', 32', 34', 36' penetrate straight into the base member 20', so that the axes of the respective peg bores define a substantially perpendicular angle with respect to the front surface 22.

Figure 10:
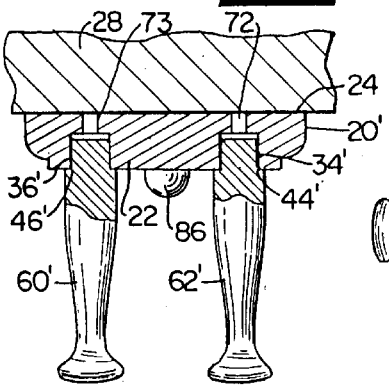
FIG. 10 is a top sectional view of the alternative embodiment mounted upon a support surface, taken substantially along line 10—10 in FIG. 8.
Figure 11:
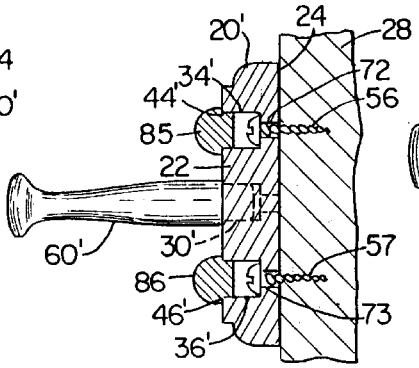
FIG. 11 is a side sectional view of the alternative embodiment mounted upon a support surface, taken substantially along line 11—11 in FIG. 9.
Figure 12:
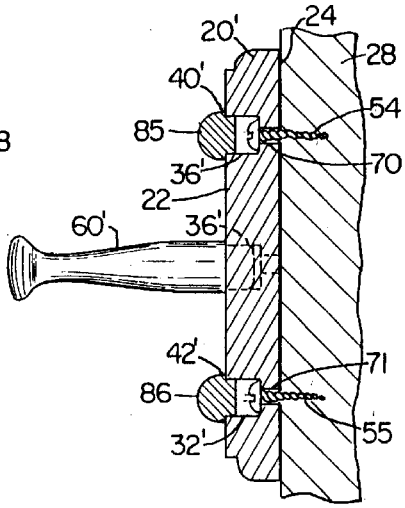
FIG. 12 is a side sectional view of the alternative embodiment mounted upon a support surface, taken substantially along line 12—12 in FIG. 8.

An aspect of the alternative embodiment is that the peg bores 30', 32', 34', 36' fill a role in the attachment of the base 20' to the support surface 28. We have determined that configuring the attachment means through the peg bores permits a more compact and aesthetic apparatus. As best seen in FIGS. 10–12, each of the peg bores 30', 32', 34', 36' only partially penetrates the base member 20'. A plurality of connector passages 70, 71, 72, 73 connect the peg bores 30', 32', 34', 36' with the back surface 24 of the base member 20'; each of the passages 70, 71, 72, 73 is substantially coaxial with its corresponding peg bore, and extends between the back surface 24 and the bottom of one of each of the peg bores 30', 32', 34', 36'. In this manner, connectors 54, 55, 56, 57, such as screws, or brads, or the like, are insertable through the passages 70, 71, 72, 73 and into the support surface 28 to attach the base 20' to the surface.

Figure 13:
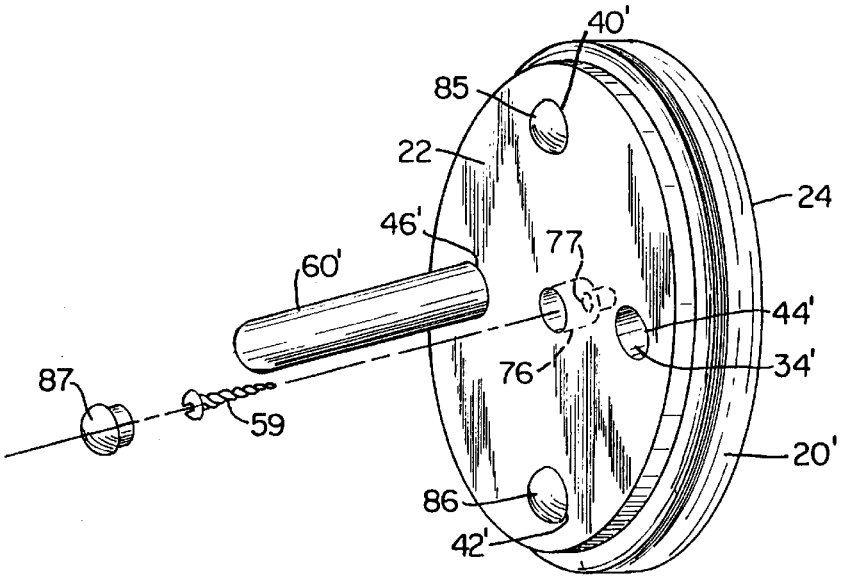
FIG. 13 is a perspective view of still another embodiment of the invention.

FIG. 13 illustrates that a base member of either embodiment, for example the base member 20' of the alternative embodiment, optionally may be provided perpendicularly and partially therethrough with a central bore 76 substantially similar to the peg bores 30', 32', 34', 36'. Coaxial with the main central bore 76 is a central connector passage 77, similar in configuration to the other connector passages 70, 71, 72, 73 previously described, which extends from the bottom of the central bore 76 to the back surface 24 of the base 20'. As illustrated by FIG. 13, a central connector 59, such as a screw, is disposable through the central connector passage 77 and into the support surface 28 to centrally fasten the base 20 to the support surface 28. Once the central connector 59 is screwed or hammered into holding contact with the bottom of the central bore 76, a central dowel button 87 may be inserted into the central bore 76 to cover the central bore 76 and connector 59.

This alternative embodiment provides a central connector 59 which may serve as an axis of rotation, whereby the rotational position of the base member 20' may be adjusted prior to final attachment to the support surface 28. Accordingly, the central connector 59 may first be disposed through the central connector passage 77 and partially inserted into the support surface 28. This allows the base member 20' to then be rotated slightly around the loosely inserted connector 59 to choose the precise position of the base member, and thereby select which pair of peg bores to use, prior to attaching the base member to the support surface with the other connectors 54, 55, 56, 57. The pegs 60', 62' can then be inserted into the selected pair of peg bores, for example bores 34' 36', for use.

Figure 14:
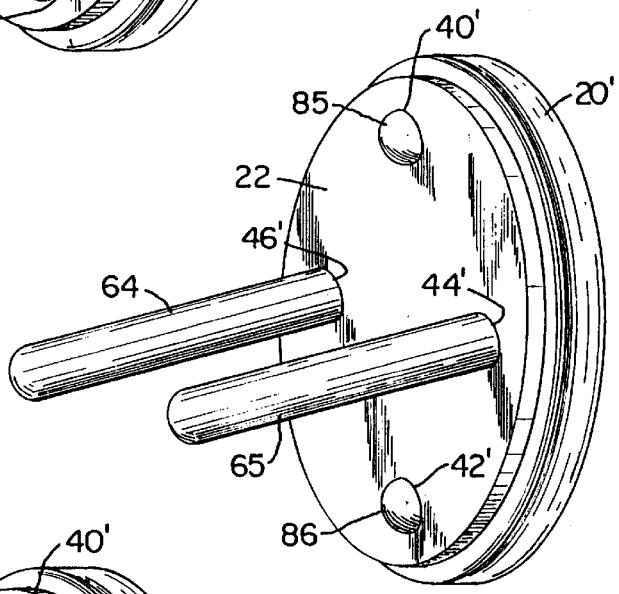
FIG. 14 is another perspective view of the embodiment shown in FIG. 13, showing pegs of a different length.
Figure 15:
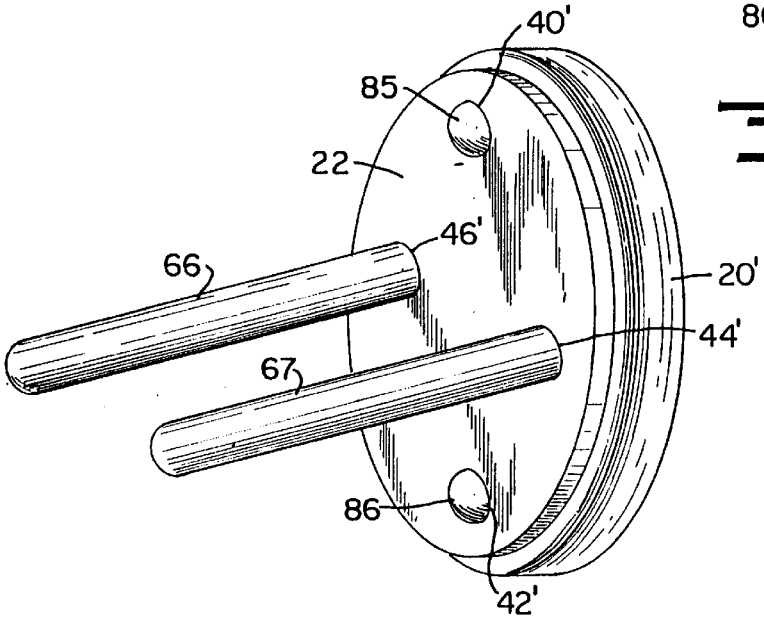
FIG. 15 is another perspective view of the embodiment shown in FIG. 13, showing pegs of yet another different length.

FIGS. 13–15 show that any embodiment of the apparatus of the invention may include additional pairs of elongate pegs 64, 65, and 66, 67. Each additional pair of pegs 64, 65 has a length different from the length of the main pegs 60', 62' (or 60, 62), and also different from the lengths of any other additional pair of pegs 66, 67. Because all pegs 60 or 60', 62 or 62', and 64, 65, 66, 67 preferably are removably insertable into the various peg bores 30, 30', 32, 32', 34, 34', 36, 36', the provision of a variety of peg lengths permits the user to mix and match peg lengths to customize the storage rack apparatus to his particular need.

Figure 16:
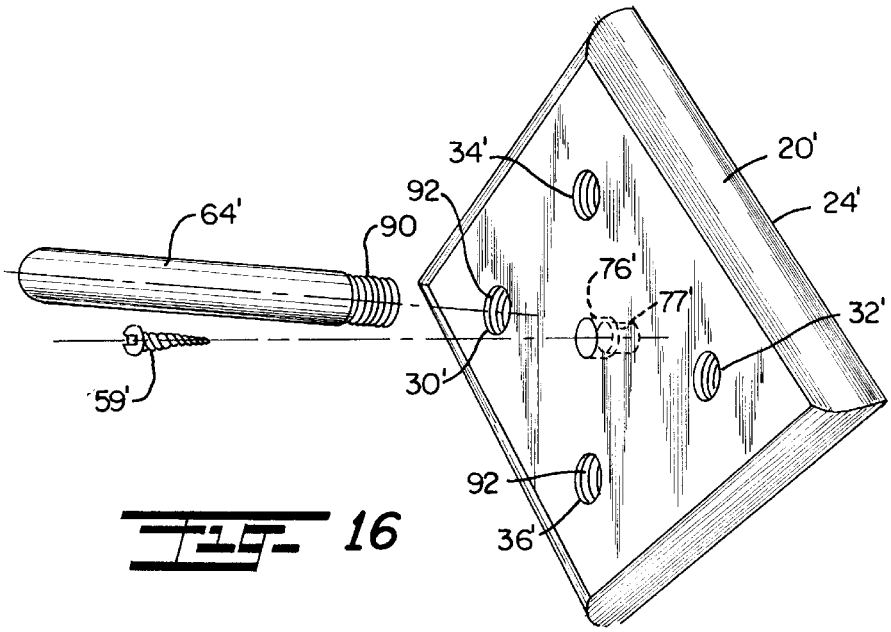
FIG. 16 is an exploded perspective view of a third embodiment of the invention, showing a threaded peg for screwed engagement into a base.
Figure 17:
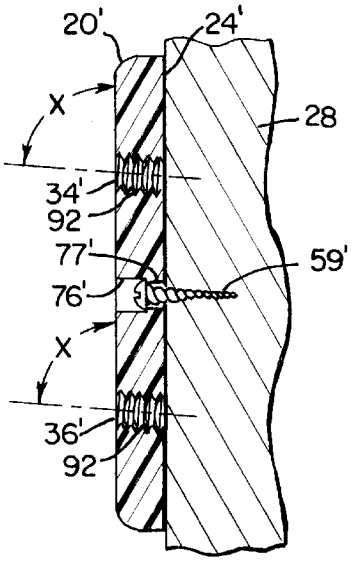
FIG. 17 is a sectional side view taken substantially along a line defined by the pair of bores vertically aligned in FIG. 16.
Figure 18:
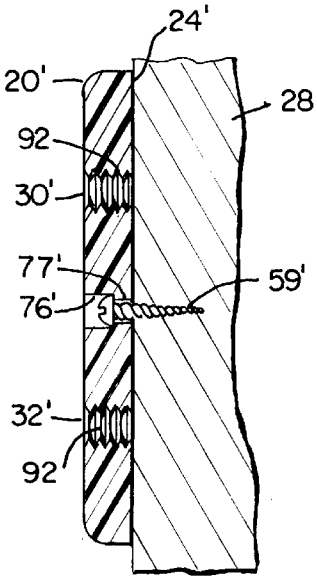
FIG. 18 is a sectional side view of the embodiment shown in FIG. 16 rotated approximately ninety degrees and taken substantially long a line defined by the pair of bores horizontally aligned in FIG. 16.

FIGS. 16–22 illustrate an alternative third embodiment of the invention. This embodiment is substantially the same in most respects to previously described embodiments, and like reference numerals and symbols designate substantially similar elements. In the alternative embodiment, the base 20' may be attached to a support surface 28 in at least two different yet functional positions. The mode of attachment is substantially according to any of the modes previously described. As illustrated in FIGS. 16–18, the base 20' may be attached substantially similar to the embodiment shown in FIG. 13. A central connector 59', such as a screw, is insertable into a counter bore 76' leading into a bore 77' and into the support surface 28 to centrally fasten the base 20' to the support surface 28. Alternatively, any of the previously described attachment schemes may be adapted for use with this embodiment.

In this alternative embodiment, the base member 20' and the pegs 64', 65' and 66' may be made from wood, but preferably are fashioned from molded plastic, for example an injection molded polyvinyl or polypropylene. Molded plastic components offer potential advantages over wood components, including increased strength and lower weight and cost. Plastic components also may be molded into customized shapes and dyed for brilliant and lasting color. Alternatively, pegs having simple cross sections and no irregular or specialized contours, such as pegs of polygonal cross-section, may be extruded for economy of manufacture, rather than being injection molded or fashioned from wood.

A desirable aspect of this alternative embodiment is the threaded insertion of the pegs 64', 65' and 66' into the base 20'. An end of each of the pegs 64', 65' and 66' is provided with a threaded portion 90 which may be screwed into a corresponding threaded portion 92 of any of the peg bores 30', 32', 34', or 36' in base 20'. The threaded portion 90 on each peg preferably comprises a threaded metal cap permanently fixed upon the plastic peg 64' for durability and security of the screwed attachment, as best shown in FIG. 16. Alternatively, as suggested in FIGS. 19 and 20, the threaded portion 90 may be integrally molded with or cut into the peg 65' or 66'. Similarly, the threaded portion 92 in each of the peg bores 30', 32', 34', or 36' may be molded into the base 20' or comprise separately manufactured, threaded inserts.

An advantage of the alternative embodiment is, therefore, the security with which the pegs 64', 65' and 66' are attached to the base 20'. More particularly, it is appreciated that the pegs 64', 65' and 66', when screwed into any one of the bores 30', 32', 34', or 36', can withstand substantial tensile or tractive forces tending to pull the pegs from the bores. For example, a clothesline may be attached to the free end of a peg 64', and considerable weight hung upon the line, without pulling the peg 64' from the bore 34' into which it has been screwed.

As shown in FIGS. 17 and 18, peg bores 30', 32', 34', and 36' may completely penetrate the base 20' for ease of manufacture, but need not do so since the threaded pegs never need to be tapped out of the bores from the direction of the back 24' of the base 20'. Thus, each of the bores 30', 32', 34', and 36' optionally may be provided with constricted connector passages (not shown in FIGS. 17 and 18) extending between the bores and the back 24 in the manner of attachment illustrated in FIGS. 10 and 11.

FIGS. 17 and 18 also indicate that one of the pairs of bores 34', 36' may include axes that are disposed at an acute angle X with respect to the face 22 of the base 20', in the manner and for the reasons described herein. The other pair of bores 30', 32' may have axes tilted at some other angle, for example, at a substantially right angle as shown in FIG. 18. Similarly, the respective pairs of peg bores 30', 32' and 34', 36' may be equally spaced, or may be separated by unequal distances, also as previously explained.

Figure 19:
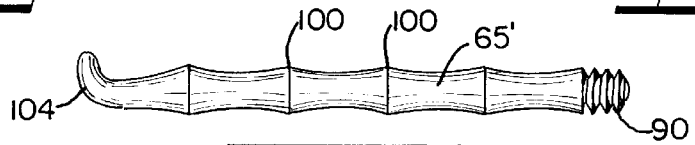
FIG. 19 is a side view of a peg in accordance with the third embodiment of the invention.
Figure 20:
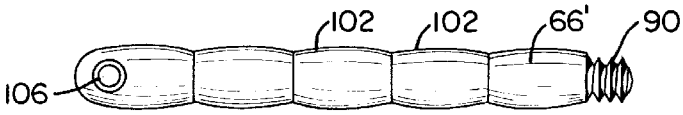
FIG. 20 is a side view of another type of peg in accordance with the third embodiment of the invention.

FIGS. 19 and 20 illustrate that the pegs 65' and 66', particularly if molded from plastic, may be shaped to improve the security with which items may be hanged thereon. Plastic is less prone to breakage than wood, and we have determined that providing an irregular surface on one or more pegs 65' or 66', that is, shaping the peg (whether made of wood or plastic) to manifest a contoured profile rather than a smooth cylinder, improves the performance and the appearance of the peg.

Peg 65' is provided, for example, with a scalloped profile whereby circumferential concave depressions define a series of annular ridges 100 along most or all the length of the peg 65'. Alternatively, as seen in FIG. 20, peg 66' may feature along its length a series of circumferential convex swells or bumps 102. Ridges 100 and bumps 102, by increasing the frictional and/or mechanical engagement between a peg 65', or 66' and an item (not shown) hanging thereon, improves the reliability of the rack as a storage device. Most especially, when a peg 65' or 66' is disposed perpendicularly to the base 20' (for example, as would result from the use of bores 30', 32 in FIG. 18, or as shown in FIGS. 6 and 7), the ridges 100 or bumps 102 will tend to cradle or engage the surface of the item to be stored, and thus reduce the likelihood that the item will slip from position upon the storage rack.

FIGS. 19 and 20 show that the pegs 65', 66' of the invention may be customized to fill specific storage needs. For example, peg 65' is provided at its free end with an integral, upwardly disposed hook portion 104 useful in situations demanding reliable hanging of, for example, an unusually light item. Peg 66' defines near its free end an eyelet 106 through which a cord, string or the like may be passed and/or tied to meet a particular use. For example, a pair of bases 20' may be secured to respective outdoor poles or posts, or to opposing walls of a room, and provided with pegs 66' having eyelets 106 therein. A cord (not shown) may then be strung through the respective eyelets 106 and tied off, to provide a temporary storage line, for example a clothesline. When the line is not in use, one or both pegs 66' may be unscrewed from their corresponding peg bores to enable the line to be reeled in and/or removed altogether.

Figure 21:
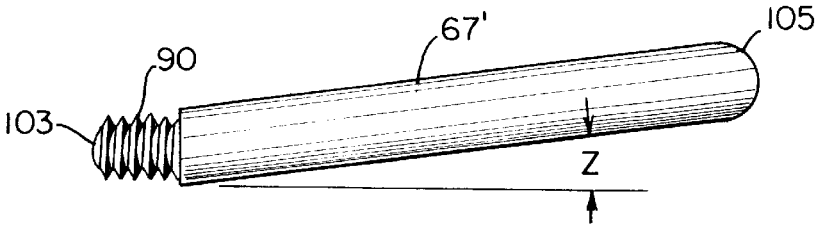
FIG. 21 is a side view of another type of peg in accordance with the third embodiment of the invention.

FIG. 21 shows how a storage rack according to the invention may be provided with a peg 67' that, when inserted into the base 20', has a portion disposed at an angle z with respect to the base 20' in instances where the peg bores 30', 32', 34', 36' have axes perpendicular to the face 22 of the base 20', for example as shown in FIG. 18. A plastic peg 67' is provided with an abbreviated portion 103, preferably corresponding with threaded portion 90, integrally formed with an angled portion 105. Abbreviated portion 103 is substantially shorter in axial length than the angled portion 105; for instance, the angled portion 105 may be four to six times as long as the abbreviated portion, as suggested in FIG. 21. The respective axes of abbreviated portion 103 and angled portion 105 intersect to define supplementary angle z therebetween.

Accordingly, the abbreviated portion 103 may be screwed perpendicularly into a threaded bore such as bore 32' in FIG. 18, and rotated until the threads are reasonably securely engaged with base 20', and also to position the angled portion 105 at different angles from the face of the base 20 such as, in an upward inclined direction as shown in FIG. 21. The peg 67' thus would define an angle X' with the face 22 of the base 20' to improve storage capability despite the perpendicularity of the bore 32', where the size of X' in degrees substantially equals ninety degrees minus the size of angle z in degrees.

Figure 22:
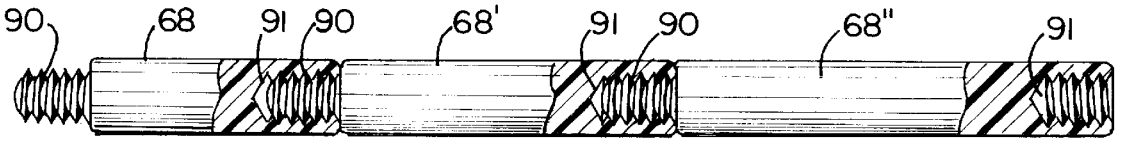
FIG. 22 is a side partially sectional view of another type of peg comprising serially connected peg segments useable in accordance with the third embodiment of the invention.

Reference is made to FIG. 22, showing that more than one specially adapted peg 68 may be interconnected in series to provide adjustability in the total length of the peg component of the invention. Two or more peg segments 68, 68', 68" are each provided at one end thereof with a threaded male portion 90, and at least one segment 68 features at the other end a threaded socket portion 91. The threaded socket 91 on one or more of each of the pegs segments 68, 68', 68" is substantially similar to a threaded peg bore in the base 20', and corresponds to the threaded male portion 90 on other peg segments. After this fashion, one peg segment 68 may be turned into a peg bore (32' in FIG. 18) in the base, and the threaded male portion 90 of another peg segment 68' screwed into the threaded socket 91 in peg segment 68. As shown in FIG. 22, still another peg segment 68" may be turned into a threaded socket 91 in the second peg segment 68'.

Thus, two or more peg segments 68, 68', 68", as suggested by a particular storage need, can be combined in series in conjunction with a given peg bore to provide for a peg component with a customized length. Notably, and as suggested in FIG. 22, the various peg segments 68, 68', 68" can be of differing axial lengths, with some segments being longer than others, so to maximize the versatility of any given set of segments 68, 68', 68". Moreover, the distal or end peg of the series need not be provided with a threaded socket 91; rather, a specially shaped peg such as hooked peg 65' in FIG. 19 may be screwed into the socket 91 of a segment 68 to serve as the distal or final peg segment in a pair or series of interconnected peg segments. It is immediately appreciated that a wide variety of lengths and types of peg components thus may be disposed in a single peg bore, expanding the adaptability of the storage rack system of the invention.

It will be immediately appreciated by one of ordinary skill in the art that the pegs 64', 65' and 66' may be adapted into any number of particular shapes, such as forked free ends, multiple eyelets, and the like. Moreover, an entire assortment of pegs 64', 65', 66', 67', 68, 68' may be liberally mixed and matched in combined use to offer a myriad of customized peg components for use in various base members 20 or 20'. The pegs accordingly serve as accessories in a system of storage rack devices, permitting the user to employ various bases 20', singly or in pairs, and in combination with an assortment of interchangeable pegs to customize the invention to specialized wall storage rack needs.

It is therefore to be understood that while preferred and alternative embodiments of the present invention are herein set forth and described, the above and other modifications and changes may be made without departing from the spirit and scope of the invention as defined by the appended claims and reasonable equivalents thereof.

We claim:

1. A storage rack apparatus comprising:

a base member attachable to a support surface and having a front surface and a back surface;

a first pair of peg bores penetrating said base member, and separated by a first distance;

a second pair of peg bores penetrating said base member, and separated by a second distance, at least one of said peg bores comprising a threaded portion; and two elongate pegs, each of said pegs insertable into a respective bore of said first and second pairs of peg bores and at least one of said pegs comprising a threaded portion for engagement with said threaded portion of at least one of said peg bores;

wherein said first distance is substantially greater than said second distance, and wherein an imaginary line connecting said first pair of bores defines an angle with respect to an imaginary line connecting said second pair of bores means for interchangeably attaching said base member to said support surface whereby a selected one of said first and second pair of peg bores into which said pegs are inserted are in horizontally spaced relation to one another and the other of said first and second pairs of peg bores into which said pegs are not inserted are in vertically space relation to one another; and said attaching means comprising a fastener insertable through each bore of said other of said first and second pairs of peg bores, thereby attaching said base member to the supporting surface.

2. An apparatus according to claim 1, wherein at least one of said pegs defines an irregular surface.

3. An apparatus according to claim 2 wherein said peg comprises a series of circumferential concave depressions defining annular ridges.

4. An apparatus according to claim 2 wherein said peg comprises a series of circumferential convex bumps.

5. An apparatus according to claim 1, wherein at least one of said pegs defines an eyelet aperture therethrough.

6. An apparatus according to claim 1 wherein at least one of said pegs comprises a hooked portion.

7. An apparatus according to claim 1, wherein said angle is a substantially perpendicular angle.

8. An apparatus according to claim 1, wherein at least one of said pegs comprises:

an abbreviated first portion; and a second portion integrated with and extending at an angle from said first portion, wherein further said first portion is insertable into one of said peg bores and said second portion is longer than said first portion.

9. An apparatus according to claim 1, wherein at least one of said pegs comprises at least two peg segments connectible in series, said peg segments each comprising a threaded male portion and at least one of said peg segments further comprising a threaded socket portion, whereby the threaded male portion of at least one peg segment is engageable with the threaded socket of another peg segment, and said other peg segment is engageable with said threaded portion of at least one of said peg bores.

10. An apparatus according to claim 9 wherein said segments comprise differing lengths.

11. A storage rack apparatus for storing objects of disparate sizes upon an upright support surface, said apparatus comprising:

a base member attachable upon the support surface, said base member comprising:

a front surface and a back surface;

suspension means consisting only of: a first pair of peg apertures in said front surface, separated by a first distance, a first pair of peg bores, each peg bore at least partially penetrating said base member from a corresponding one of said first pair of peg apertures, and comprising, an axis, and a threaded portion and a second pair of peg apertures in said front surface, separated by a second distance substantially shorter than said first distance; and a second pair of peg bores, each peg bore at least partially penetrating said base member from a corresponding one of said second pair of peg apertures, and comprising, an axis, and a threaded portion wherein axes of said first pair of peg bores extend along a first oblique angle with respect to said front surface, and axes of said second pair of peg bores extend along a second oblique angle with respect to said front surface;

at least two elongate threaded pegs for engagement into a selected pair of said pairs of peg bores; means for interchangeably attaching said base member to the support surface whereby respective bores of either one of said first and second pairs of peg bores into which said pegs are inserted are in horizontally spaced relation to one another and the other of said first and second peg bores are in vertically spaced relation to one another.

12. The apparatus of claim 11, wherein said axes of said first pair of peg bores are skewed with respect to said axes of said second pair of peg bores.

13. An apparatus according to claim 11, wherein at least one of said pegs defines an irregular surface.

14. An apparatus according to claim 13, wherein said peg comprises a series of circumferential concave depressions defining annular ridges.

15. An apparatus according to claim 13 wherein said peg comprises a series of circumferential convex bumps.

16. An apparatus according to claim 11, wherein at least one of said pegs defines an eyelet aperture therethrough.

17. An apparatus according to claim 11 wherein at least one of said pegs comprises a hooked portion.

18. An apparatus according to claim 11, wherein at least one of said pegs comprises:

an abbreviated first portion; and a second portion integrated with and extending at an angle from said first portion, wherein further said first portion is insertable into one of said peg bores and said second portion is longer than said first portion.

19. An apparatus according to claim 11, wherein at least one of said pegs comprises at least two peg segments connectible in series, said peg segments each comprising a threaded male portion and at least one of said peg segments further comprising a threaded socket portion, whereby the threaded male portion of at least one peg segment is engageable with the threaded socket of another peg segment, and said other peg segment is engageable with said threaded portion of at least one of said peg bores.

20. An apparatus according to claim 19 wherein said segments comprise differing lengths.

* * * * *